US007525243B2

(12) United States Patent
Bae et al.

(10) Patent No.: US 7,525,243 B2
(45) Date of Patent: Apr. 28, 2009

(54) CRT FOR DISPLAY DEVICE WITH SHATTER PROOF MEMBER ATTACHED TO FUNNEL USING ADHESIVE

(75) Inventors: Joon-Soo Bae, Suwon-si (KR); Hoo-Deuk Kim, Suwon-si (KR); Kyou-Bong Lee, Suwon-si (KR); Seok-Nam Lee, Suwon-si (KR); Yun-Ho Chang, Suwon-si (KR); Chang-Ryon Byon, Suwon-si (KR); Do-Hun Pyun, Suwon-si (KR); Mun-Seong Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 17 days.

(21) Appl. No.: 11/354,871

(22) Filed: Feb. 16, 2006

(65) Prior Publication Data

US 2006/0186784 A1 Aug. 24, 2006

(30) Foreign Application Priority Data

Feb. 18, 2005 (KR) ..... 10-2005-0013471

(51) Int. Cl.
*H01J 29/88* (2006.01)

(52) U.S. Cl. ..... 313/479; 313/482; 313/364

(58) Field of Classification Search ..... None
See application file for complete search history.

(56) References Cited

U.S. PATENT DOCUMENTS

| | | | | |
|---|---|---|---|---|
| 3,166,211 | A * | 1/1965 | Stel et al. | 220/2.1 A |
| 3,350,154 | A * | 10/1967 | Minneman et al. | 445/8 |
| 4,158,419 | A * | 6/1979 | Nolan | 220/2.1 A |
| 5,300,856 | A * | 4/1994 | Bartch et al. | 313/479 |
| 6,288,759 | B1 * | 9/2001 | Cho et al. | 348/836 |
| 6,797,876 | B2 * | 9/2004 | Matsudate et al. | 174/388 |
| 6,900,584 | B2 * | 5/2005 | Ha et al. | 313/407 |
| 2003/0011295 | A1 * | 1/2003 | Swank et al. | 313/479 |
| 2003/0020848 | A1 * | 1/2003 | Broer et al. | 349/61 |

FOREIGN PATENT DOCUMENTS

| | | |
|---|---|---|
| JP | 4-69842 | 6/1992 |
| JP | 9-45263 | 2/1997 |
| JP | 10-144238 | 5/1998 |
| JP | 2001332193 | * 11/2001 |
| JP | 2001332193 A | * 11/2001 |

* cited by examiner

*Primary Examiner*—Toan Ton
*Assistant Examiner*—Britt Hanley
(74) *Attorney, Agent, or Firm*—Robert E. Bushnell, Esq.

(57) ABSTRACT

A Cathode Ray Tube (CRT) includes a panel having an inner phosphor screen, a funnel connected to the panel and adapted to have a deflection unit arranged thereon and a neck connected to the funnel and having an electron gun arranged therein. A shatter-proof member is installed on the funnel to prevent the tube from shattering.

11 Claims, 7 Drawing Sheets

CRT FOR DISPLAY DEVICE WITH SHATTER PROOF MEMBER ATTACHED TO FUNNEL USING ADHESIVE

CLAIM OF PRIORITY

This application makes reference to, incorporates the same herein, and claims all benefits accruing under 35 U.S.C. § 119 from an application for CATHODE RAY TUBE (CRT), earlier filed in the Korean Intellectual Property Office on 18 Feb. 2005 and there duly assigned Serial No. 10-2005-0013471.

BACKGROUND OF THE INVENTION

1. Field of the Invention

The present invention relates to a Cathode Ray Tube (CRT), and more particularly, to a CRT which is prevented from breaking and flying into pieces.

2. Description of the Related Art

Generally, a Cathode Ray Tube (CRT) is includes a glass tube with a panel, a funnel, and a neck. The tube is evacuated to be in a vacuum state such that electrons are emitted therein to excite phosphors and display the desired images.

When the CRT endures mechanical or thermal impacts in an air atmosphere, cracks are generated in the glass tube, shattering it such that the glass is broken into pieces, and scattered.

The glass shattering is from the side of the panel or the side of the funnel depending upon the shape of the tube or the stress applied thereto.

In order to solve such a problem, considering that the stress is concentrated on a skirt of the panel of the CRT, an explosion proof band with a predetermined tension is provided on the skirt of the panel. With this structure, when cracks are generated in the skirt, they are not developed so that the glass shattering can be prevented.

With the recent trends related to CRTs, in order for CRTs to be competitive as compared to a Plasma Display Panel (PDP), a liquid crystal display or an organic field emission display, the tube size must be reduced to make the CRT slimmer. The length of the funnel is then shorter as compared to that of the common CRT.

Accordingly, upon receipt of an external force, the slimmed CRT generates cracks at the funnel portion thereof due to the distorted funnel shape so that glass pieces are liable to be scattered from the side of the funnel to the side of the panel.

In this consideration, the explosion proof band mounted at the panel side is shortto prevent the scattering of glass pieces from the slimmed CRT.

Alternatively, efforts have been made to prevent the glass tube from being shattered by attaching a film to the side of the panel. However, such a film is not enough to prevent the glass shattering, and involve a high production cost.

SUMMARY OF THE INVENTION

It is an object of the present invention to provide a Cathode Ray Tube (CRT) which prevents the glass from shattering due to the cracks generated from the side of a funnel upon receipt of an external impact.

According to one aspect of the present invention, the CRT includes: a panel including an inner phosphor screen; a funnel connected to the panel and adapted to have a deflection unit arranged thereon; a neck connected to the funnel and having an electron gun arranged therein; and a shatter-proof member attached the funnel to prevent the tube from shattering.

The shatter-proof member preferably includes a material different from that of the tube. The shatter-proof member preferably includes a fire retardant material. The shatter-proof member preferably includes glass fibers. The shatter-proof member is preferably attached to an outer surface of the funnel by an adhesive. The adhesive preferably includes one or more materials selected from the group consisting of epoxy resin, silicon resin, urethane resin, and rubber-based polymer. The adhesive preferably includes a film, and the shatter-proof member is preferably attached to the funnel while being covered by the adhesive.

The shatter-proof member is preferably arranged on a portion of the funnel. More than one shatter-proof members are preferably cross-arranged on the funnel. More than one shatter-proof members are preferably arranged on the funnel around the neck and are symmetrical to each other. The shatter-proof member is preferably arranged at the interface of the panel and the funnel where the panel and the funnel are sealed to each other.

According to another aspect of the present invention, the CRT includes: a panel including an inner phosphor screen; a funnel connected to the panel and adapted to have a deflection unit arranged thereon; a neck connected to the funnel and having an electron gun arranged therein; and a reinforcing member attached to the tube by an adhesive, the reinforcing member of a material different from that of the tube.

The reinforcing member is preferably arranged on the funnel. The reinforcing member is preferably arranged at the interface of the panel and the funnel where the panel and the funnel are sealed to each other. The reinforcing member is preferably arranged on the funnel and at the interface of the panel and the funnel where the panel and the funnel are sealed to each other. The reinforcing member preferably includes a fire retardant material. The reinforcing member preferably includes glass fibers.

The adhesive preferably includes one or more materials selected from the group consisting of epoxy resin, silicon resin, urethane resin and rubber-based polymer. The adhesive preferably includes a film, and the reinforcing member is preferably attached to the tube while being covered by the adhesive.

The reinforcing member is preferably arranged on a portion of the funnel. The reinforcing members are preferably cross-arranged on the funnel. The reinforcing members are preferably arranged on the funnel around the neck and are symmetrical to each other. The reinforcing member is preferably arranged along the interface of the panel and the funnel where the panel and the funnel are sealed to each other.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

The present invention is described more fully hereinafter with reference to the accompanying drawings, in which exemplary embodiments of the present invention are shown.

Figure 1:
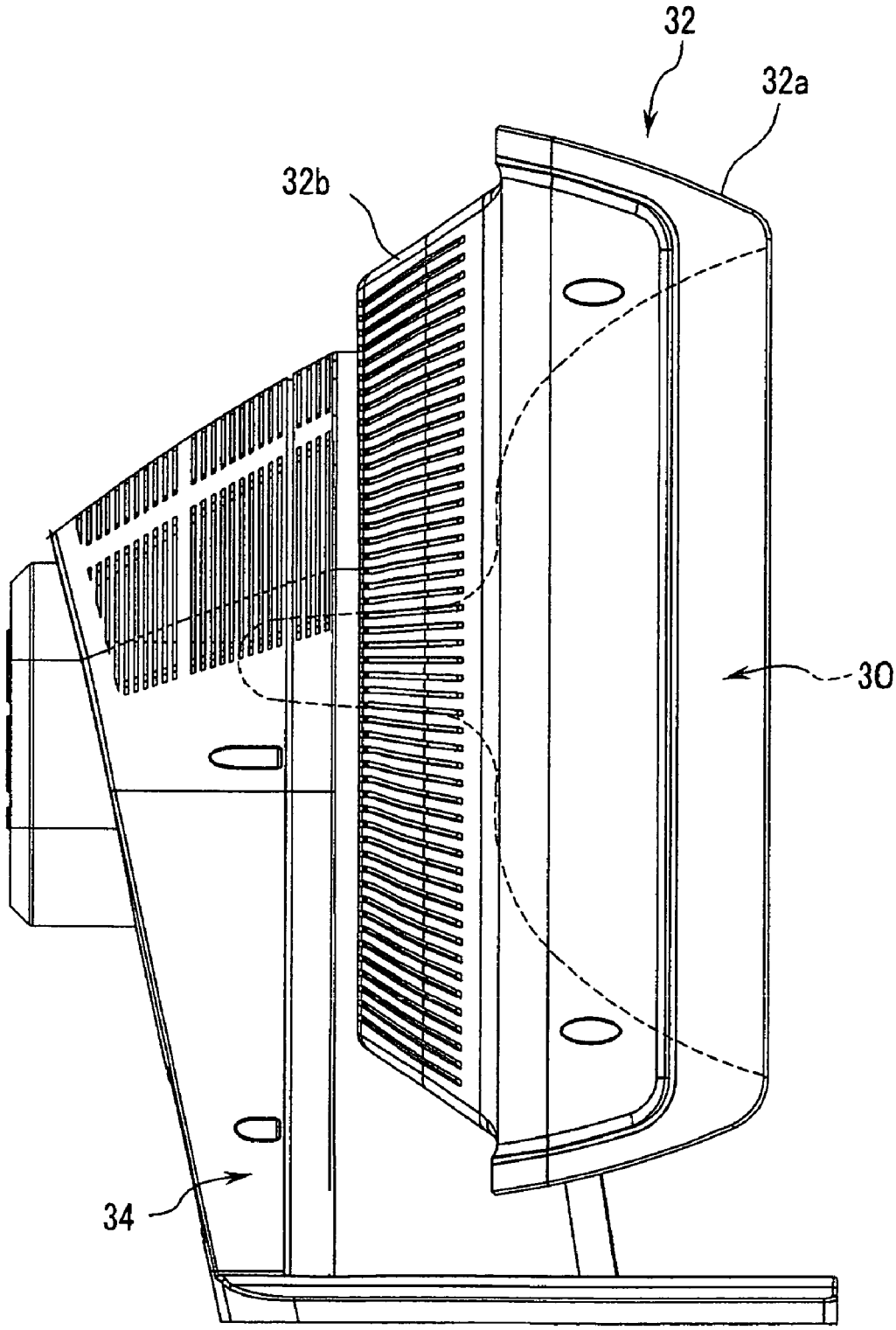
FIG. 1 is a side view of a display device with a Cathode Ray Tube (CRT) according to an embodiment of the present invention.

FIG. 1 is a side view of a display device with a Cathode Ray Tube (CRT) according to an embodiment of the present invention.

As shown in FIG. 1, the display device includes a CRT 30 for displaying images, a case 32 surrounding the CRT 30 while outlining the overall device, and a support 34 connected to the case 32 to suspend the case 32.

The case 32 is formed with front and back cases 32*a* and 32*b* arranged at the front and rear of the CRT 30 and attached to each other with screws. The support 34 is formed into a stand.

The CRT 30 is wholly located within the case 32 such that the neck thereof is inside of the support 34.

Figure 2:
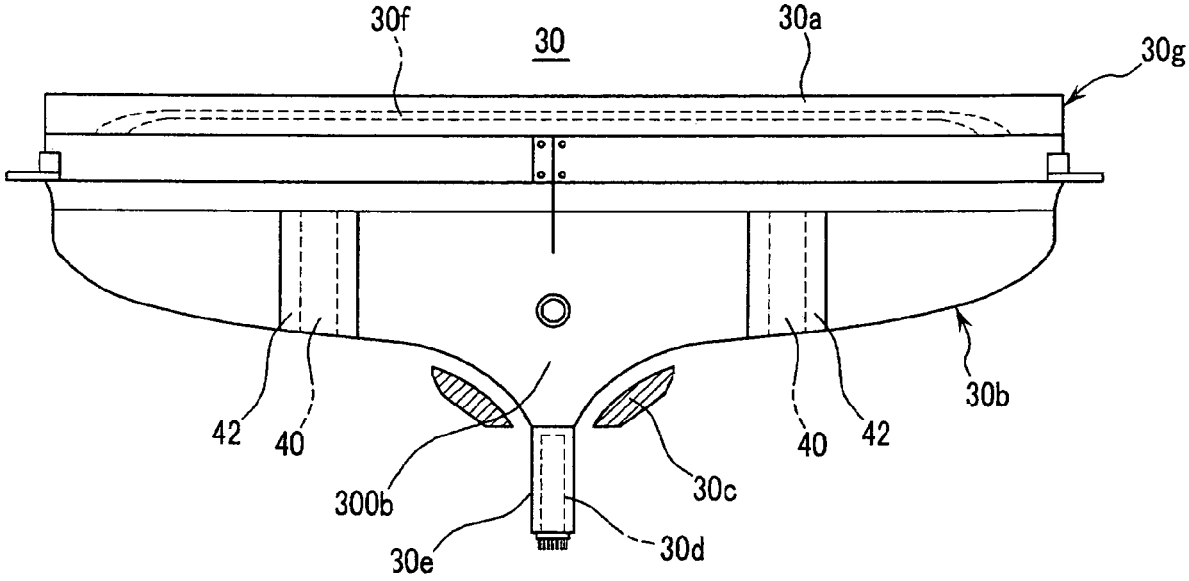
FIG. 2 is a plan view of the CRT according to the embodiment of the present invention.
Figure 3:
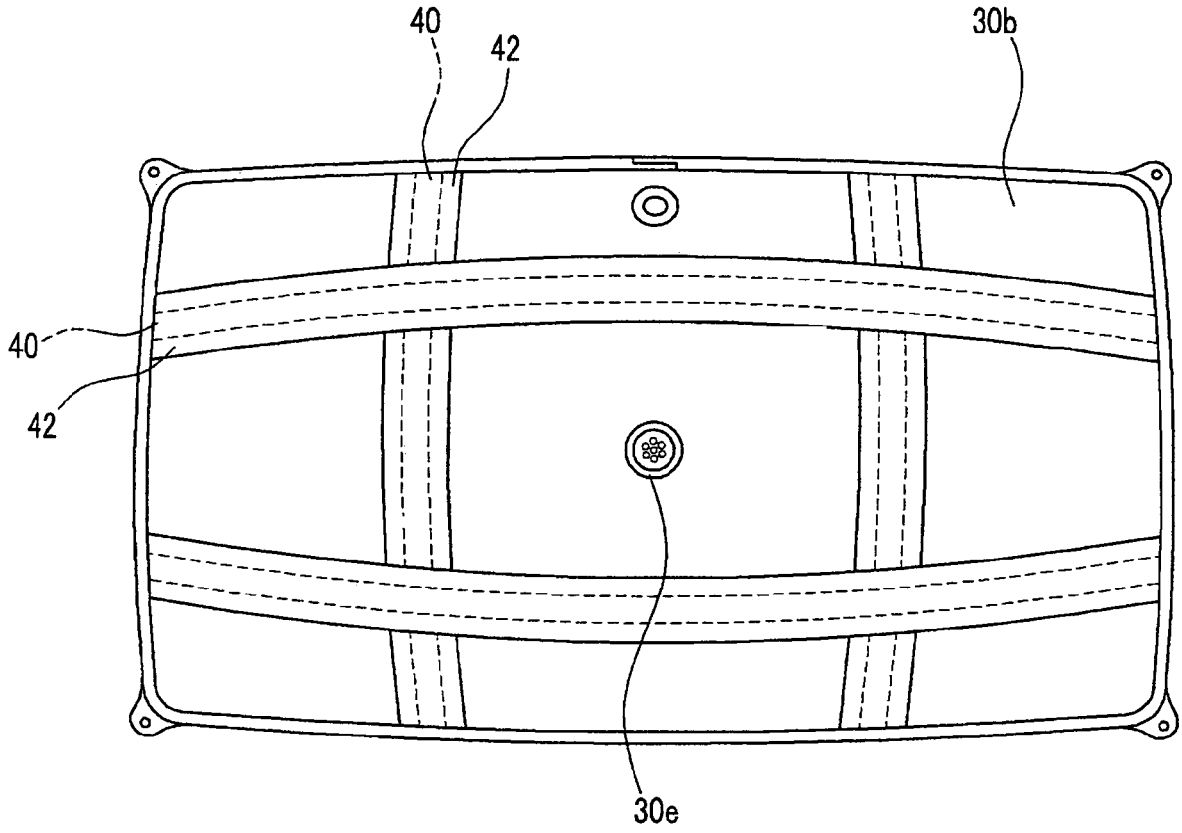
FIG. 3 is a rear view of the CRT according to the embodiment of the present invention.

FIG. 2 is a plan view of the CRT 30, and FIG. 3 is a rear view of the CRT 30.

As shown in the drawings, the CRT 30 includes a tube 30*g*, which has a rectangular panel 30*a* with a inner phosphor screen 30*f*, a funnel 30*b* connected to the panel 30*a* and having a deflection unit 30*c* arranged on the outer circumference of a cone 300*b* thereof, and a neck 30*e* connected to the rear of the cone 300*b* and having an electron gun 30*d* mounted thereon.

With the CRT 30, the tube 30*g* is internally kept in a vacuum state, and electron beams emitted by the electron gun 30*d* are deflected by the deflection unit 30*c* in the directions of the long axis of the panel 30 (the horizontal axis, the direction of the x axis of FIG. 2) and the short axis thereof (the vertical axis, the direction of the y axis of FIG. 2). The deflected electron beams pass through beam passage holes of a color selection unit (not shown) mounted within the panel 30*a*, and land on target phosphors of the phosphor screen 30*f*, thereby displaying the desired images.

With the CRT 30, cracks are liable to be generated at the tube 30*g* when it endures mechanical or thermal impacts from the outside, causing the tube 30*g* to break into pieces, and scattered. As described below, the CRT is provided with an arrangement for solving such a problem.

As shown in FIGS. 2 and 3, shatter-proof members 40 are provided on the funnel 30 of the CRT 30 to prevent the tube 30*g* from shattering.

The shatter-proof members 40 prevent the shattering of the tube 30*g* due to cracks generated thereon and hold the original shape thereof, and hence, can be referred to as reinforcing members for the tube 30*g*, and which is for explanatory convenience are referred to below collectively as the shatter-proof member.

With a common CRT, considering that the tube 30*g* with the panel 30*a*, the funnel 30*b* and the neck 30*e* is formed of glass, the shatter-proof member is formed of a material different from that of the glass tube 30*g*.

In this embodiment, a fire retardant material is used for the shatter-proof member 40, such as glass fibers. However, the material for the shatter-proof member 40 is not limited thereto.

The shatter-proof member 40 is attached to the outer surface of the funnel 30*a* by an adhesive 42. The adhesive 42 is formed of one or more high temperature resistant materials selected from epoxy resin, silicon resin, urethane resin, and rubber-based polymers such as butadiene rubber, acrylonitrile butadiene rubber and chloroprene rubber.

In this embodiment, the adhesive 42 is formed of an epoxy resin film. The shatter-proof members 40 are formed on the outer surface of the funnel 30*b*, and each covered by the adhesive film 42 such that it is attached to the funnel 30*b* due to the adhesion of the adhesive 42.

FIGS. 2 and 3 illustrate the cross-arrangement of the shatter-proof members 40 around the neck 30*e*. However, the pattern of the shatter-proof members is not limited thereto. That is, the shatter-proof member 40 can be provided on another portion of the funnel 30*b*.

Figure 4:
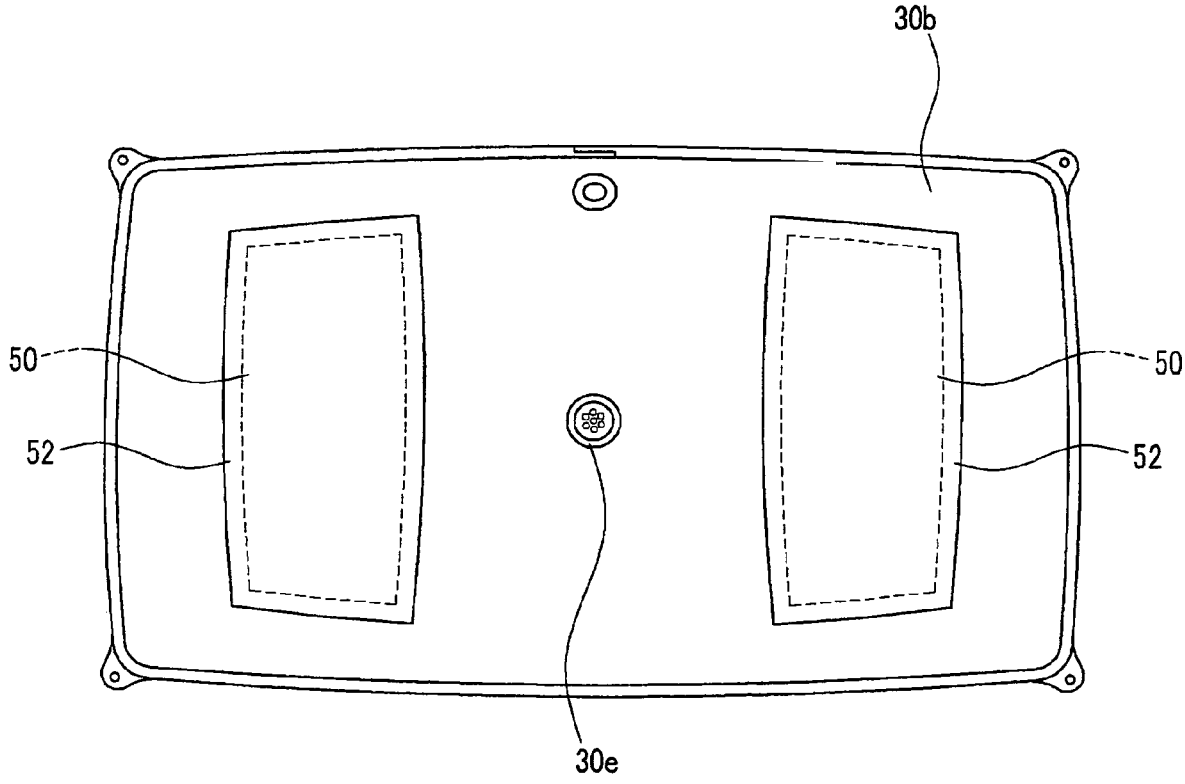
FIG. 4 is a rear view of a CRT according to another embodiment of the present invention.

FIG. 4 is a view of another embodiment of the present invention where shatter-proof members 50 are arranged on the funnel 30*b* around the neck 30*e* symmetrical to each other (in the left and right sides of the drawing). The shatter-proof members 50 can be attached to the funnel 30*b* using an adhesive 52 as in the previous embodiment.

As described above, the shatter-proof members 40 can be placed at suitable locations on the funnel 30*b* in consideration of the practical shape of the tube 30*g* or the stress distribution thereon.

The locations of attachment of the shatter-proof members are not limited to the funnel. Considering that with the common CRT, cracks are mainly generated in the contact area of the panel and the funnel where the sealing thereof occurs, the shatter-proof members according to an embodiment of the present invention can be attached to the seal area.

Figure 5:
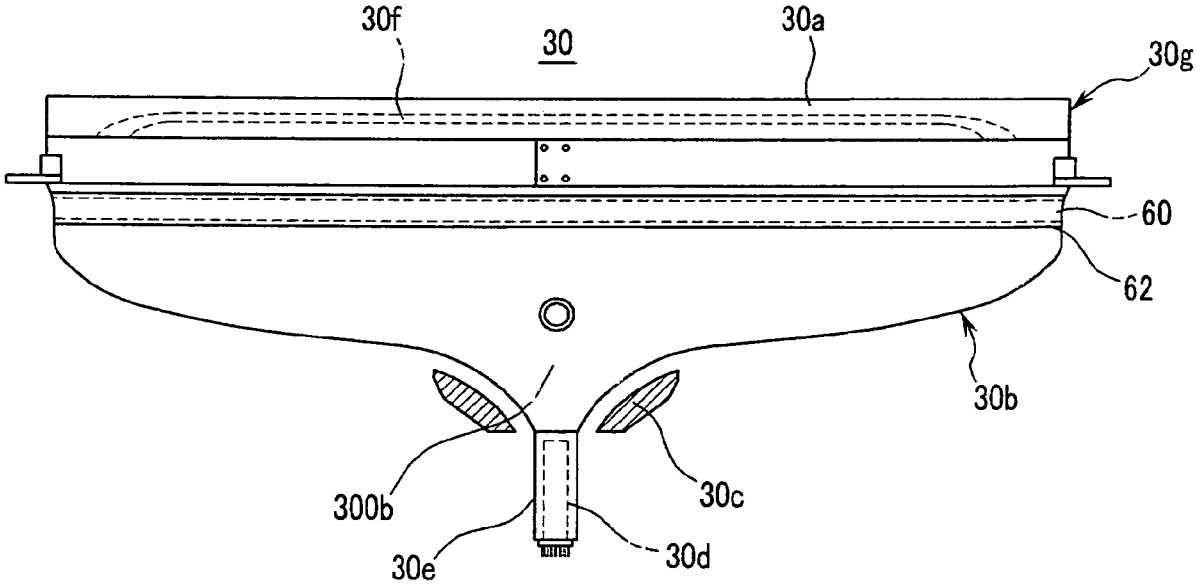
FIG. 5 is a plan view of a CRT according to still another embodiment of the present invention.

FIG. 5 is a view of the attachment of a shatter-proof member 60 to the contact area of the panel 30*a* and the funnel 30*b* using an adhesive film 62.

Figure 6A:
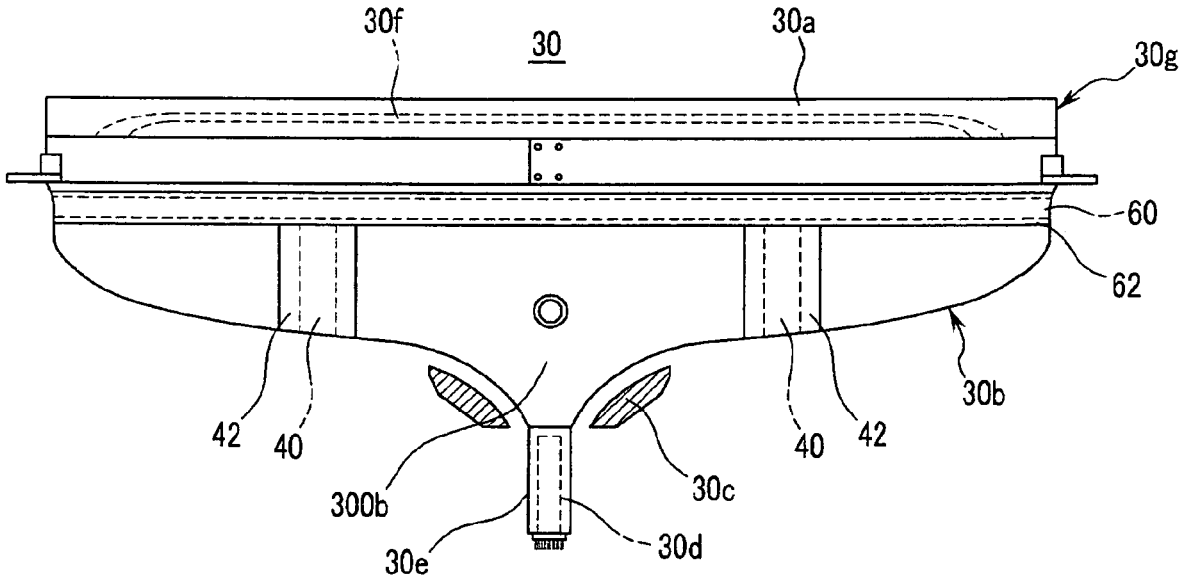
FIGS. 6A and 6B are plan views of a CRT according to still another aspect of the present invention.
Figure 6B:
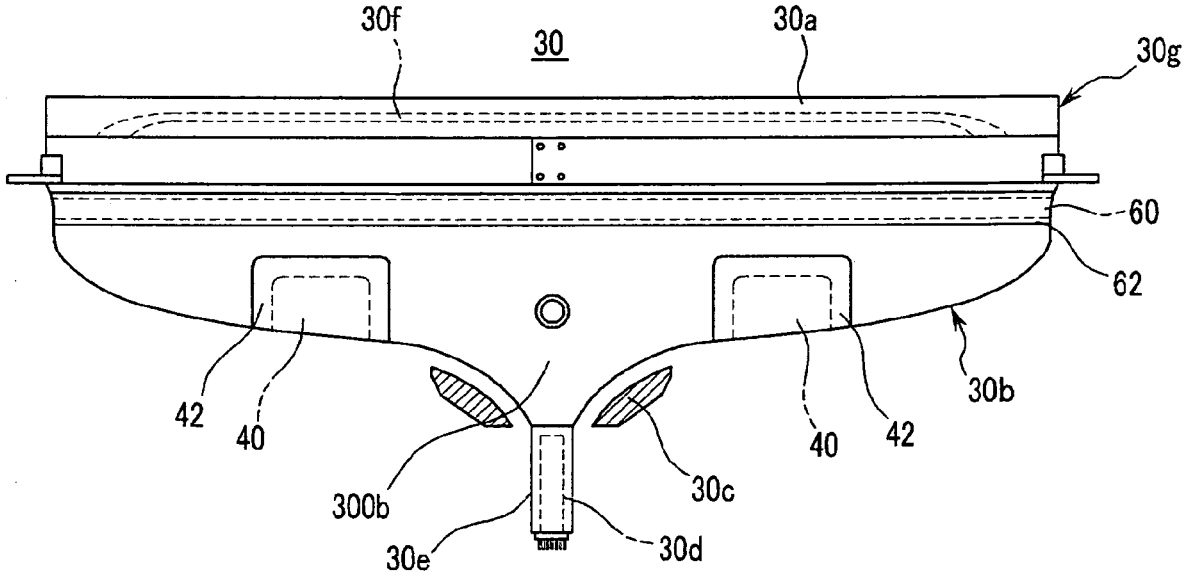

In order to heighten the effect of the shatter-proof member, it can be attached to the funnel 30*b* as well as to the contact area of the panel 30*a* and the funnel 40*b* (as shown in FIGS. 6A and 6B).

With the above-structured CRT, even though the tube is speedily heated under the application of thermal impact occurring during a fire while generating thermal stress and cracks so that the tube is broken, the shatter-proof members provided at the funnel or/and the contact area of the panel and the funnel constantly hold the tube pieces, which are prevented from being scattered.

Moreover, in this embodiment, as the shatter-proof member is formed with a fire retardant material, it securely holds the broken tube even under the emergent conditions such as a fire to prevent the broken tube pieces from being scattered.

The effect of the shatter-proof member can be further exerted with a slimmed CRT where the funnel length is shorter than that of the common CRT.

As described above, with the CRT in accordance with the present invention, even though it is formed as a slimmed tube depending upon the interest of the consumers, the shattering of the tube in the presence of cracks can be effectively prevented due to the operation of the shatter-proof members formed on the tube, and the consumers do not suffer safety problems due to the tube shattering. This effect can be facilitated together with the operation of a common explosion proof band.

Although exemplary embodiments of the present invention have been described in detail hereinabove, it should be clearly understood that many variations and/or modifications of the basic inventive concept herein taught which can appear to those skilled in the art will still fall within the spirit and scope of the present invention, as defined in the appended claims.

What is claimed is:

1. A Cathode Ray Tube (CRT), comprising:

a panel including an inner phosphor screen;

a funnel connected to the panel and having a deflection unit arranged thereon;

a neck connected to the funnel and having an electron gun arranged therein; and a shatter-proof member directly attached to the funnel by an adhesive film to prevent the tube from shattering, the adhesive film attached to an outer surface of the funnel and covering the shatter-proof member and extending on the outer surface of the funnel beyond the shatter-proof member to attach the shatter-proof member to the funnel by the adhesive film.

2. The CRT of claim 1, wherein the shatter-proof member comprises a material different from that of the tube.

3. The CRT of claim 1, wherein the shatter-proof member comprises a fire retardant material.

4. The CRT of claim 1, wherein the shatter-proof member comprises glass fibers.

5. The CRT of claim 1, wherein the adhesive film comprises one or more materials selected from the group consisting of epoxy resin, silicon resin, urethane resin, and rubber-based polymer.

6. The CRT of claim 1, wherein the shatter-proof member is attached to the funnel while being covered by the adhesive film.

7. A Cathode Ray Tube (CRT), comprising:

a panel including an inner phosphor screen;

a funnel connected to the panel and having a deflection unit arranged thereon;

a neck connected to the funnel and having an electron gun arranged therein;

a reinforcing member directly attached to the funnel by an adhesive film, the reinforcing member being a material different from that of the tube, and the adhesive film attached to an outer surface of the funnel and covering the reinforcing member and extending on the outer surface of the funnel beyond the reinforcing member to attach the reinforcing member to the funnel by the adhesive film.

8. The CRT of claim 7, wherein the reinforcing member comprises a fire retardant material.

9. The CRT of claim 7, wherein the reinforcing member comprises glass fibers.

10. The CRT of claim 7, wherein the adhesive film comprises one or more materials selected from the group consisting of epoxy resin, silicon resin, urethane resin and rubber-based polymer.

11. The CRT of claim 7, wherein the reinforcing member is attached to the tube while being covered by the adhesive film.

* * * * *